US005588233A

United States Patent [19]

Volkert et al.

[11] Patent Number: 5,588,233

[45] Date of Patent: Dec. 31, 1996

[54] PAPER PRODUCT AND METHOD OF MAKING

[75] Inventors: Carolyn K. Volkert, Evanston; Andrew M. Volkert, Northfield, both of Ill.

[73] Assignee: Volkert, Inc., Northfield, Ill.

[21] Appl. No.: 286,674

[22] Filed: Aug. 5, 1994

[51] Int. Cl.[6] ..... G09F 3/00

[52] U.S. Cl. ..... 40/124.1; 40/539; 446/148; 428/43

[58] Field of Search ..... 40/124.1, 539, 40/160; 446/148, 149, 150; 428/43

[56] References Cited

U.S. PATENT DOCUMENTS

| | | | |
|---|---|---|---|
| 2,152,299 | 3/1939 | Arndt | 40/126 |
| 2,156,815 | 5/1939 | Levy | 40/125 |
| 2,544,783 | 3/1951 | Freedman et al. | 40/126 |
| 2,609,639 | 9/1952 | Barker | 46/34 |
| 2,742,723 | 4/1956 | Klein et al. | 446/148 |
| 3,995,388 | 12/1976 | Penick et al. | 40/126 A |
| 4,103,444 | 8/1978 | Jones et al. | 40/124.1 |
| 4,149,630 | 4/1979 | Transport | 206/45.24 |
| 4,592,573 | 6/1986 | Crowell | 283/56 |
| 4,833,802 | 5/1989 | Volkert | 40/124.1 |
| 5,022,681 | 6/1991 | Penick | 446/148 X |
| 5,181,901 | 1/1993 | Volkert | 493/331 |

*Primary Examiner*—Kenneth J. Dorner
*Assistant Examiner*—Cassandra Davis
*Attorney, Agent, or Firm*—Fitch, Even, Tabin & Flannery

[57] ABSTRACT

Sheet material pieces comprising a plurality of panels that are connected together in hinged relationship are fabricated so that a stand-out structure die-cut into one of the panels assumes an attention-attracting, 3-dimensional orientation upon the opening of the hinged panels as a result of interconnection of portions of the stand-out structure with the facing panel surface. Because one panel can be imperforate, if desired, particular advantages are obtained in mass production and other machine-assembly methods as a result of such a configuration. A variety of methods are shown for efficiently producing such pieces via mass-production, including items having multiple stand-out structures. Flat individual sheets are particularly adapted to be conveyed through laser printers, copy machines and other suitable imprinting equipment in order to inexpensively personalize such finished items.

20 Claims, 7 Drawing Sheets

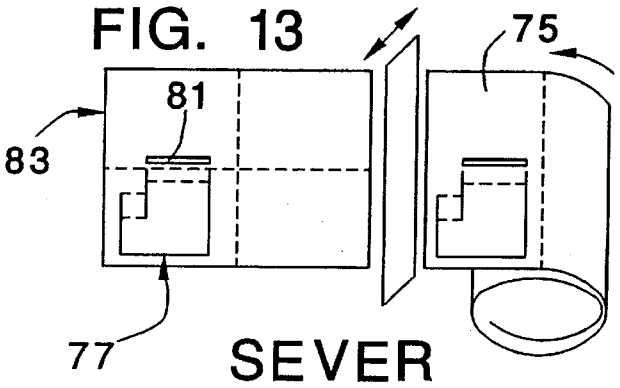
FIG. 13
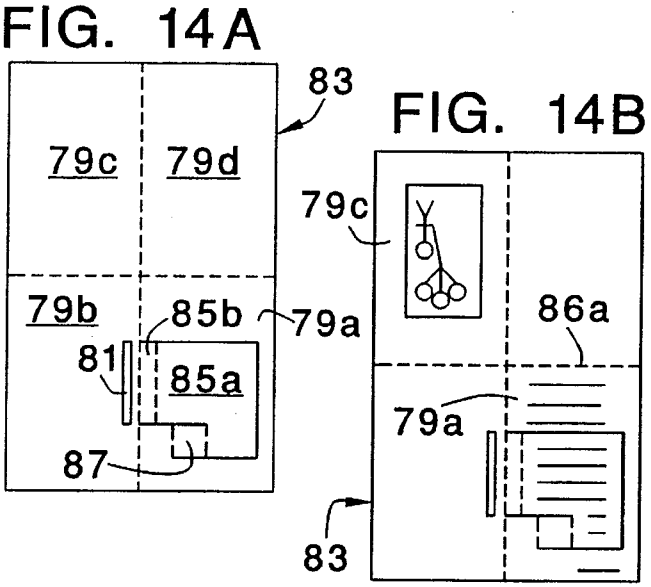
FIG. 14B
FIG. 14A
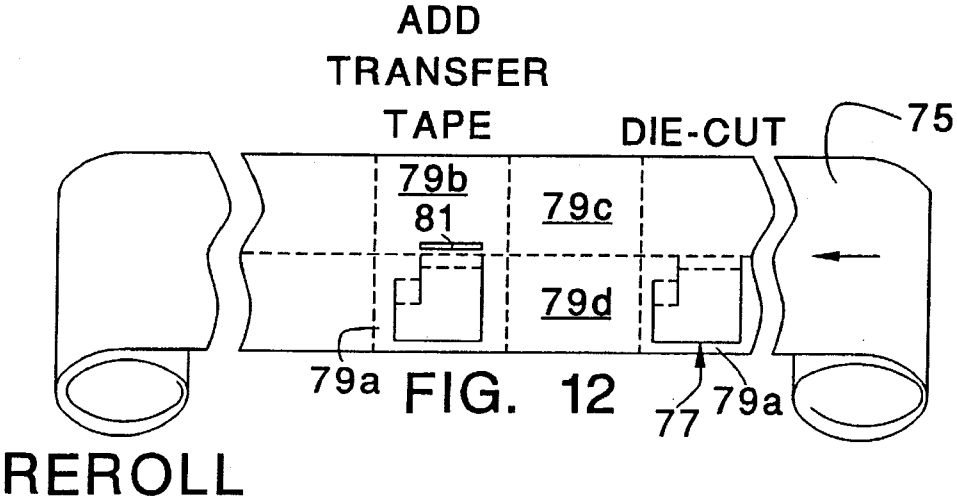
FIG. 12
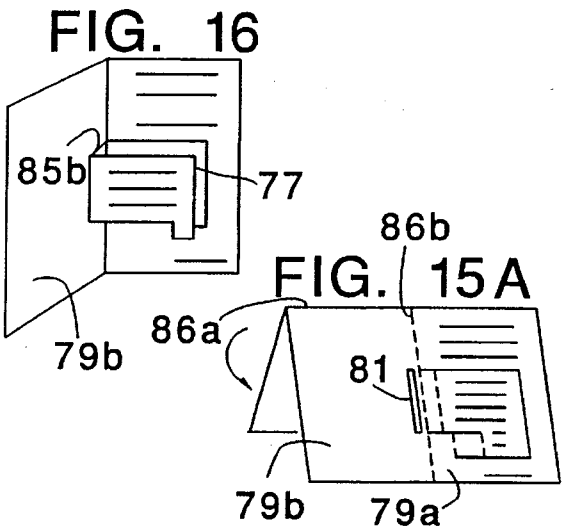
FIG. 16
FIG. 15A
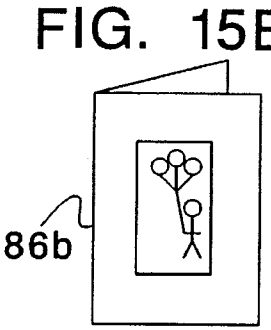
FIG. 15B 109
93a
99a
93d
103
97a
101
103a
101a
93c 93d
93a
109
99a
97a
103
93b
101
93c 109
93b
107
101a
101
101
108
93d
SEVER
93a
97
97
105
FOLD UPPER HALF
91
97
93a
101a
101
93b
93c
103
103a
95
99
93d
FOLD
APPLY ADHESIVE
FOLD
DIE-CUT
APPLY ADHESIVE 125a
129
123a
117
115b
121
123
115a 133
115a
119
117
125
115b
123
125a
115c 115a
FOLD UPPER HALF
117
115a
121
123
115b
127
115c
133
129
115b
129
115d
131
SEVER
125
125a
115d
117
117
119
FOLD
APPLY ADHESIVE
FOLD
DIE-CUT
APPLY ADHESIVE

PAPER PRODUCT AND METHOD OF MAKING

This invention relates generally to promotional items made of paper or other sheet material, and more particularly, it relates to promotional sheet material items, particularly those which can be mass-produced, either from a continuous web or from separate sheets, by die-cutting and application of adhesive or other bonding material and which result in an attractive, attention-getting final product.

BACKGROUND OF THE INVENTION

Three-dimensional structural arrangements have long been used in greeting cards and the like and have fairly recently become frequently used in advertising and in other promotional endeavors.

U.S. Pat. Nos. 2,609,639, and 2,152,299 are generally representative of patents which show techniques sometimes referred to as "box-folds" that have been used in greeting cards and the like. U.S. Pat. No. 4,103,444 shows the use of this general technique in making advertising leaflets (see FIG. 5) and the use of strips from one panel to open a flap in an opposite panel. U.S. Pat. No. 4,592,573 shows the use of this technique in stationery items.

Such pieces have now become generally available to the advertising field as a result of the developments shown in several earlier patents, particularly U.S. Pat. No. 3,995,388, issued Dec. 7, 1976, which discloses methods for making pop-up paper products having significant advantages over hand-assembly methods that had been generally theretofore employed. U.S. Pat. No. 4,146,983, issued Apr. 3, 1979, discloses other methods for making novel promotional items, particularly those which are designed to present a plurality of coupons or the like to a recipient upon the opening of a folder. U.S. Pat. Nos. 4,337,589, 4,349,973, 4,833,802, and 4,963,125 disclose still other manufacturing techniques that are specifically suited for mass production of pop-up advertising pieces on a web-press or the like, the disclosures of which patents are incorporated herein by reference.

The foregoing patents describe different manufacturing techniques useful for making advertising and promotional pop-ups as a part of a continuous web arrangement, and pop-ups such as these have been frequently used to create impact and enjoyment in books, in greeting cards and in advertising inserts. These advances in designs and in manufacturing methods have enabled the volume production of such products at significant cost savings and thus have increased their use.

A particularly attractive characteristic of such dimensional items is the construction of a pop-up element which rises upward from a flat, substantially single plane to assume a three-dimensional orientation upon the opening of a pair of cover pieces or basepieces, which may generally form a folder inside of which the pop-up is located. By attaching pop-up elements of these general types to opposite panels of a pair of basepieces, for example along angles created by lines of weakness (e.g. score lines and/or perforations) in combination with adhesive bonds, it is possible to create pressure or stress points on each such bond which, upon opening of one cover, cause the pop-up to be erected. The pressure or stress which is created upon opening is usually sufficient so that, when the cover is manually released, it will draw the cover either partially or entirely closed.

Although substantial design effort has heretofore been expended in creating a variety of different dimensional structures and designs, improved designs continue to be sought, as are methods for mass production of such improved designs.

SUMMARY OF THE INVENTION

It has now been found that an attention-attracting sheet material item can be provided by die-cutting only a single panel from a pair of first and second facing panels which are hinged together along a straight line, e.g. a fold-line, in the final item. Such a die-cut in the first panel creates a stand-out structure which should contain at least one line of weakness and which contains a linkage that preferably interconnects the stand-out to the remainder of the first sheet material panel. This one line of weakness preferably extends parallel to the hinge line and creates at least one subpanel hinged to the main body panel of the die-cut stand-out. By applying adhesive or the like onto the sheet material in only a single area, one subpanel can be interconnected to the second facing panel to create an assemblage which, upon the unfolding of the first and second panels, causes the stand-out structure to prominently move out of the plane of the first panel from which it has been die-cut while remaining substantially parallel thereto in an attention-attracting mode. In another embodiment of the invention, the die-cut structure has a main panel which remains directly hinged to the remainder of the first panel and contains a linkage which remains hinged to it that is appropriately adhered to the imperforate facing panel. In such an arrangement, the die-cut structure may be hinged along a line at an angle to the fold-line between the facing panel, or multiple die-cut panels might be provided as a part of a 3 or 4-panel folded item wherein one structure moves through an opening provided in the die-cut adjacent panel. These designs wherein die-cutting occurs in only a single panel lends themselves to considerable savings in material, enhance structural aesthetics and facilitate mass production methods because the region of a continuous web, or even a single sheet, which constitutes an imperforate panel can be readily conveyed under tension and run at high speed, permitting the region wherein the die-cut structure is located to be manipulated, by mechanical folding or the equivalent, into superimposition thereatop. In addition, high-speed mass production methods become particularly feasible when adhesive or other bonding application is effected in a single location on one panel on each item or piece.

DETAILED DESCRIPTION OF THE PREFERRED EMBODIMENTS

Figure 1:
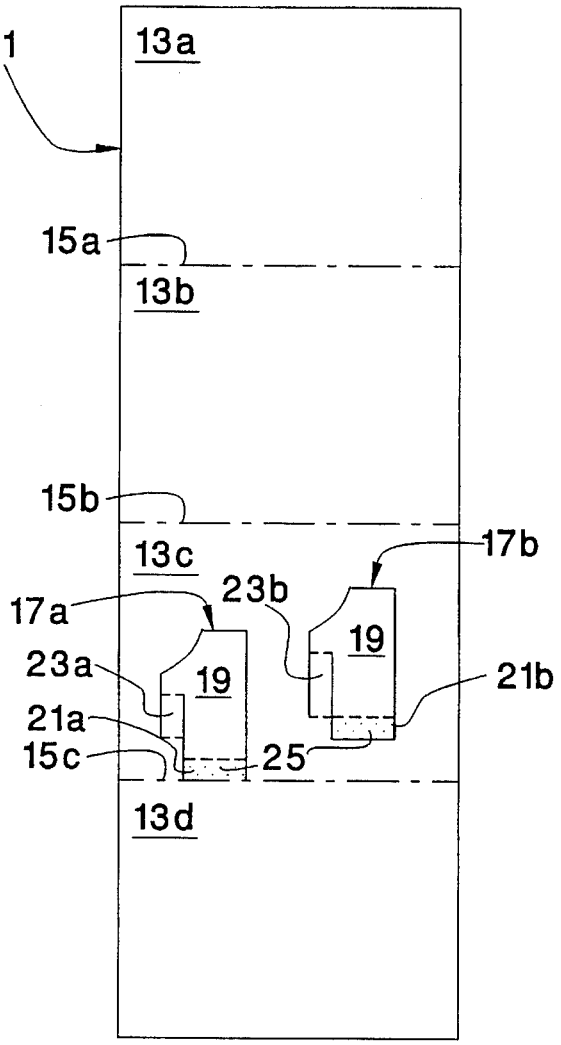
FIG. 1 is a plan view of a blank having four panels which has/been die-cut preliminary to forming a dimensional item embodying various features of the present invention.

Illustrated in FIG. 1 is a blank 11 which is designed to be folded to create an attention-attracting dimensional sheet material item. The blank 11 includes 4 panels 13*a, b, c* and *d,* of equal dimension which are interconnected to one another along fold-lines 15*a, b* and *c* which, if desired, can be lines of weakness formed in the sheet material of the blank itself by scoring, creasing, perforating or the like. Any suitable sheet material can be used, such as paper, fiberboard, lightweight plastic or the like; however, a medium-weight paper stock, such as that often seen in greeting cards, may be preferred in many instances. Die-cut into panel 13*c* are two structurally similar stand-out structures 17*a* and 17*b* each having generally the shape of the numeral 1. Each stand-out structure has a main body portion 19 in the shape of the numeral 1, an underlying rectangular subpanel 21 and a link 23, which is connected or hinged by a line of weakness at its upper end to the main body 19 and at its lower end to the remainder of the overall panel 13*c*. The lower subpanels 21*a* and *b* are also connected or hinged by lines of weakness to the bottom of the respective subpanel 19. At its lower edge, the subpanel 21*a* is hinged to the panel 13*d* along the fold-line 15*c,* while the lower edge of subpanel 21*b* is die-cut so as to be free of any connection.

Figure 2:
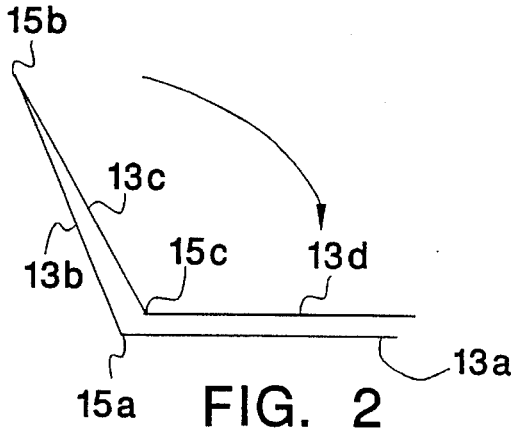
FIG. 2 is a side view of the blank of FIG. 1 showing a step in the fabrication of the dimensional piece.

In the illustrated embodiment, an adhesive pattern 25 is applied to the surface of each subpanel 21. Any suitable adhesive, e.g., hot-melt or solvent-based, can be used in such a fabrication process. Such permanent-type adhesive is understood to be such as to have a bond strength that is generally higher than the tear strength of the fibers. Other such adhesive arrangements, including heat, ultrasonic or RF-activated adhesives or micro-encapsulated adhesives, can alternatively be used. If desired, co-adhesive patterns of a material that will only adhere to itself can be applied to the appropriate locations of opposite surfaces, as is known in this art. The blank 11 is then first folded along the fold-line 15*b,* and then it is simultaneously folded along fold-lines 15*a* and 15*c* as illustrated in FIG. 2. The subsequent folding step brings panels 13*c* and 13*d* into contact with each other, causing the adhesive 25 to join the surfaces of the subpanels 21 to mirror-image locations on the facing panel 13*d.*

Figure 3:
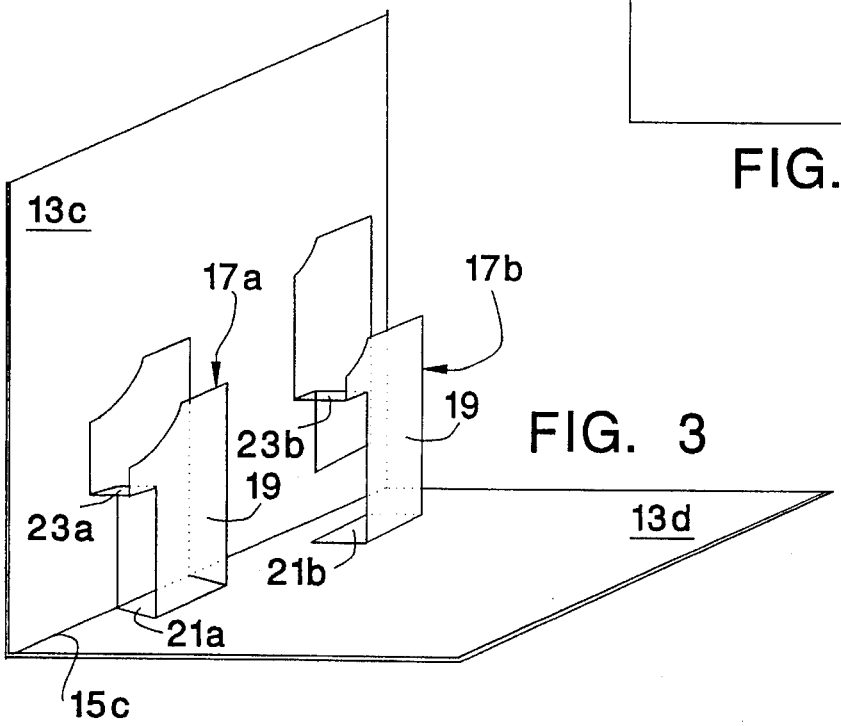
FIG. 3 is a perspective view showing the dimensional piece of FIG. 1 in its opened orientation following fabrication.

When the folded dimensional piece is opened as illustrated in FIG. 3, the panel 13*c* moves away from the panel 13*d,* and the subpanels 21, which are affixed by the adhesive pattern 25 to the surface of the imperforate panel 13*d,* move with the panel 13*d* because the lower edge of the subpanel 21*b* is die-cut from the panel 13*c*. This causes the stand-outs 17 to assume a 3-dimensional orientation guided by the links 23 which interconnect the subpanels 19 and the remainder of the panel 13*c*. The links 23*a* and 23*b* are respectively proportioned to allow the stand-out to assume an orientation generally parallel to the panel 13*c,* in an attractive attention-getting mode.

Figure 4:
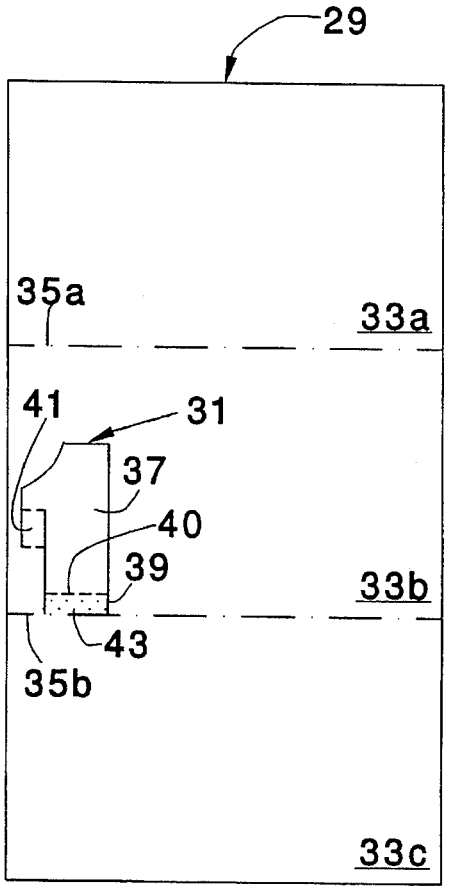
FIG. 4 is a plan view of a sheet of letter-size stationery or the like which has been die-cut and treated to embody various features of the invention.
Figure 5:
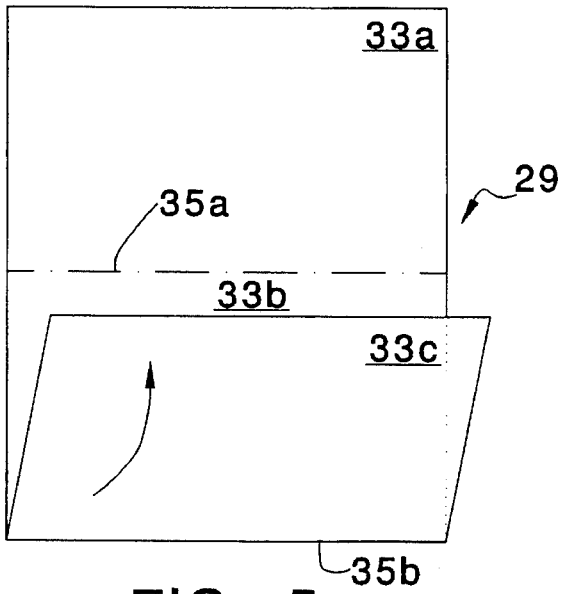
FIG. 5 shows a first step in the folding of the letter stationery of FIG. 4 which can be accomplished automatically or semi-automatically following printing if mass production distribution is intended.
Figure 6:
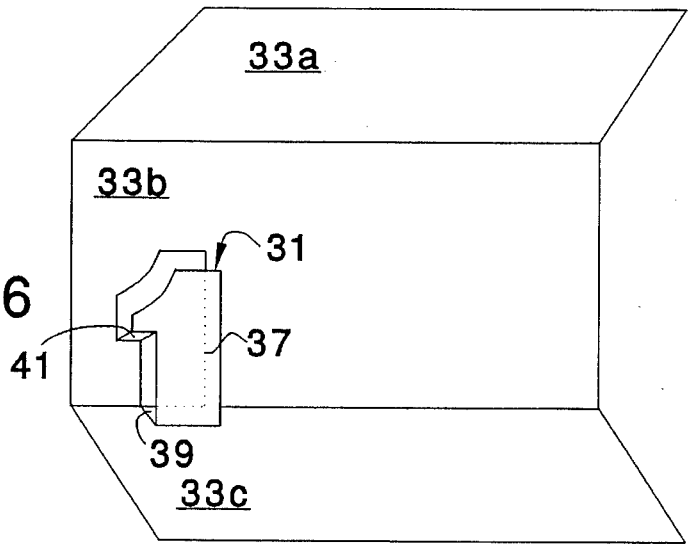
FIG. 6 is a perspective view showing the letter of FIG. 4 as it would appear when opened by the recipient.

Depicted in FIGS. 4, 5 and 6 is a sheet 29, which may be a sheet of letter-writing stationery or the like, into which a stand-out structure 31 has been die-cut. The stand-out structure is located in the central panel of three panels 33*a,* 33*b* and 33*c* of generally equal dimension. These panels can be separated from one another by lines of weakness 35*a* and 35*b,* if desired, or indicia can simply be printed on the sheet 29 along the edges to show where folding should take place. The stand-out structure 31 has a main body portion 37 in the shape of the numeral 1, an underlying rectangular subpanel 39 which is hinged to the main body portion 37 along line of weakness 40 and to the panel 33*c* along the fold-line 35*b*. A link 41 is respectively hinged to the main body 37 and to the remainder of the panel 33*b*. A suitable adhesive pattern 43 is applied to the subpanel 39. If the sheet is to be used as stationery, it may be desirable to apply remoistenable adhesive or to apply pressure-sensitive adhesive covered by a release layer.

After printing or writing on the sheet 29 has been completed, the adhesive 43 is activated, as by moistening the adhesive or by removing a release layer, and the panel 33*c* is folded along the fold-line 35*b* so that it comes into surface-to-surface contact with the panel 33*b,* as depicted in FIG. 5. As a result of this folding step, the subpanel 39 becomes adhered to the surface of the panel 33*c*. Finally, the panel 33*a* is folded along the fold-line 35*a* to complete the folding of the sheet 29, and it is delivered as by mailing to a recipient. Upon opening by the recipient, the stand-out structure 31 becomes prominently and attractively displayed because the subpanel 37 moves away from the plane of the panel 33*b*, guided by the appropriately proportioned linkage arm 41, and assumes an orientation generally parallel thereto in an attention-attracting fashion.

Figure 7:
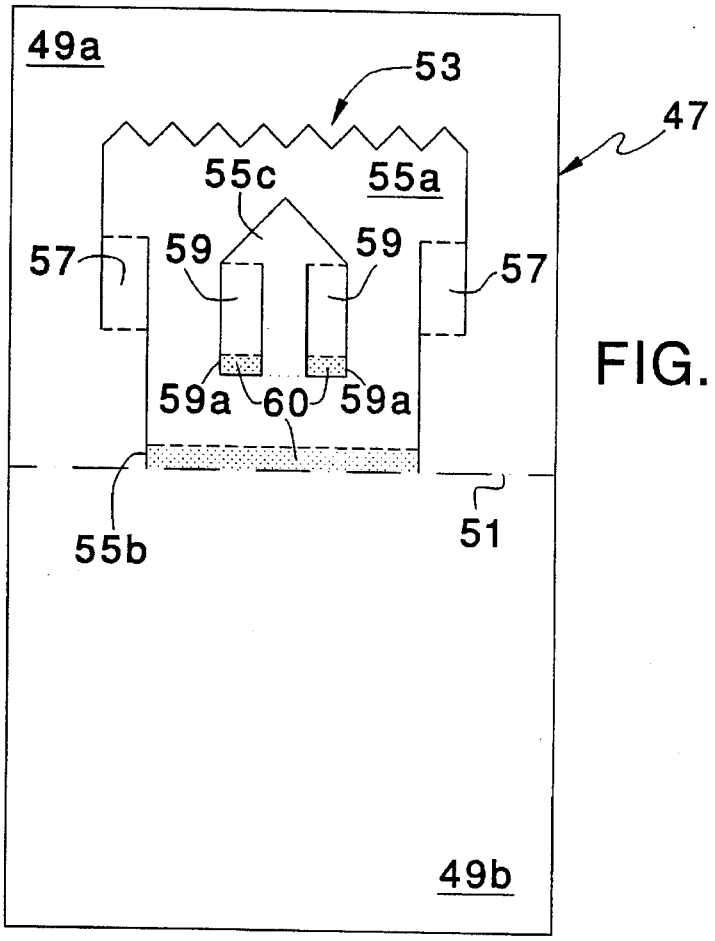
FIG. 7 is a plan view of another blank which has been die-cut and treated so as to provide an intermediate piece ready for fabrication into a dimensional piece similar to that shown in FIGS. 1–3.
Figure 8:
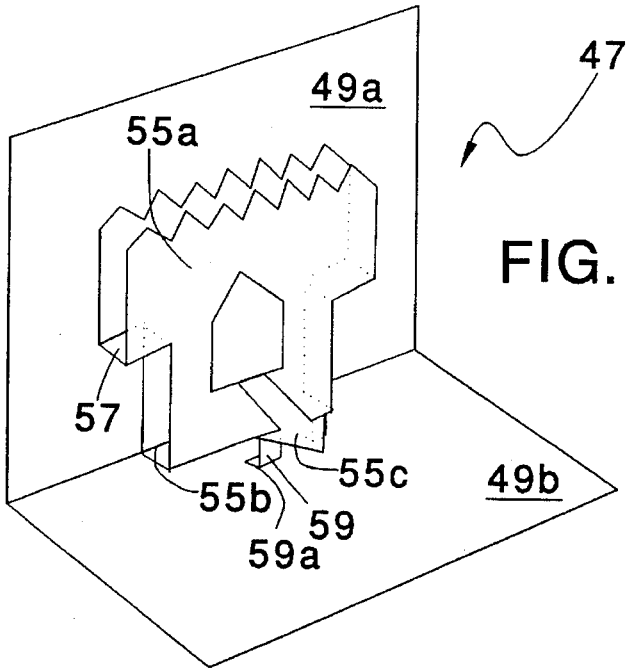
FIG. 8 is a perspective view of the finished piece formed from the blank of FIG. 7 shown in its opened position.

Illustrated in FIGS. 7 and 8 is another blank 47 which is formed to have a pair of panels 49*a* and 49*b* of equal dimension hinged to each other along a line of weakness 51. Die-cut into the upper panel 49*a* is a stand-out structure 53 which includes a main body portion 55*a*, an underlying subpanel 55*b* and a central, arrow-like subpanel 55*c* which is die-cut in the center of the main body 55*a*. The subpanel 55*b* is connected along its lower edge to the panel 49*b* by the fold-line 51; along its upper edge, it is hinged along a line of weakness to the main body 55*a*. A pair of laterally located linkages 57 respectively interconnect flanking regions of the main subpanel 55*a* of the stand-out structure to the remainder of the overall panel 49*a*. A pair of secondary linkages 59 are hinged at their upper ends to the arrow subpanel 55*c*; they include auxiliary subpanel portions 59*a* at their lower ends which are die-cut at the bottom from the remainder of the main body 55*a*, thus remaining connected along an upper line of weakness to the secondary links 59. A pattern of adhesive or other bonding material 60 is applied to the subpanel 55*b* and to the auxiliary subpanels 59*a*. As a result, these three rectangular regions become affixed to the surface of the panel 49*b* when the die-cut blank 47 is folded along the line 51 so as to superimpose one panel 49 atop the other, creating a piece that includes this stand-out structure.

When the completed piece is opened as shown in FIG. 8, the stand-out structure 53 assumes a 3-dimensional configuration, with the panel 55*a* assuming an orientation generally parallel to the plane of the panel 49*a* moved by the affixation of the subpanel 55*b* to the panel 49*b*, and guided by the appropriately proportioned links 57. However, the arrow-like subpanel 55*c* assumes an orientation generally perpendicular to the panel 49*a* as a result of the attachment of the auxiliary subpanels 59*a* at the lower ends of the links secondary 59 to a more central region of the panel 49*b*. To present a clean appearance, a line of weakness is preferably provided at the base of the arrow subpanel 55*c*.

Figure 9:
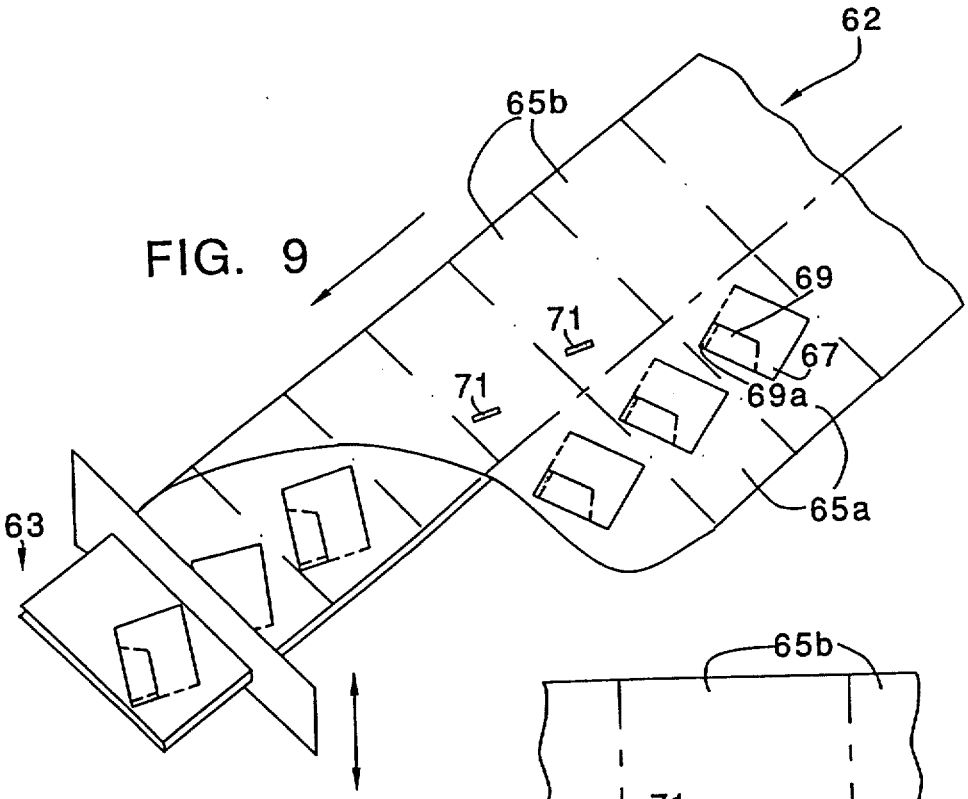
FIG. 9 is a perspective view showing a continuous web which is being die-cut and treated to fabricate a series of structurally identical dimensional pieces embodying various features of the invention.
Figure 10:
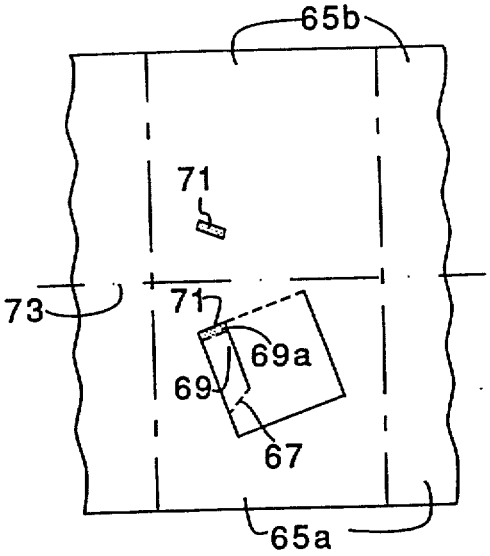
FIG. 10 is a fragmentary plan view of a section of the web being operated upon in the method of FIG. 9.

Illustrated in FIG. 9 is a continuously moving web 62 which may be fed from a roll of sheet material or from a web press or the like, which web is designed to create a plurality of structurally identical, dimensional pieces 63. As best seen in FIG. 10, each of the pieces is designed to be fashioned from a pair of panels 65*a* and 65*b* of generally equal dimension. As the web moves from right to left in FIG. 9, the panels 65*a* are die-cut to form a stand-out structure having a main body 67 located generally centrally within the panel together with a linkage arm 69 hinged to the main body 67. The linkage arm 69 has a subpanel 69*a* at its free end destined for affixation to the opposite panel 65*b*. Following the die-cutting step, co-adhesive patterns 71 are applied to both panels 65*a* and 65*b* so that co-adhesive 71 covers the subpanel 69*a* as well as a corresponding aligned location on the facing panel 65*b*. Next, the web 62 is folded in half along a line 73 which then becomes a fold-line for the ultimate piece 63. When the panels 65*a* and 65*b* are brought into surface-to-surface contact with each other, the regions carrying the co-adhesive become affixed to each other, i.e. the subpanel 69*a* becomes affixed to the panel 65*b*. It should be understood, of course, that instead of applying co-adhesive to both panels, adhesive could be applied to one panel or the other to create a similar joinder upon the folding of the web in half. Because the panels 65*b* are imperforate, high tension can be maintained in this half of the web while the die-cut half of the web is folded over it, thus permitting high-speed operation.

Figure 11:
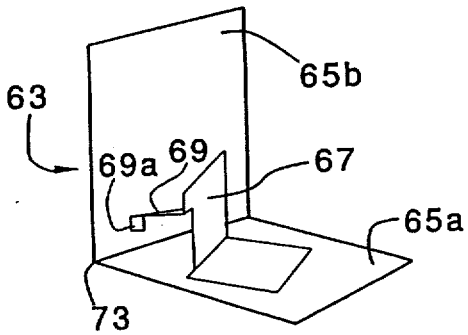
FIG. 11 is a perspective view showing a piece produced from the web of FIG. 10 in its opened orientation.

Following folding, as depicted in FIG. 9, the web is severed by a suitable cutter which may be reciprocating as shown or any other suitable cutter can be employed so as to cut the web into a series of individual, structurally identical pieces 63. Alternatively the pieces 63 could be re-rolled, fan-folded in stacks or severed in multiples, e.g. of 3. When an individual piece 63 is opened, as depicted in FIG. 11, the joinder of the subpanel 69*a* to the panel 65*b* causes the link 69 to pull the stand-out structure from the plane of the panel 65*a* and prominently display it in 3-dimensional configuration. Because the main body 67 is hinged at an angle of about 25° to the fold-line 73, it presents an unusual and attractive appearance.

Illustrated in FIGS. 12 through 16 is an example as to how the invention may be utilized in the growing field of personalized greeting cards or the like which are printed at the point of sale to the customer by a computer-driven laser printer or the like from a roll of sheet material stock.

Figure 12:
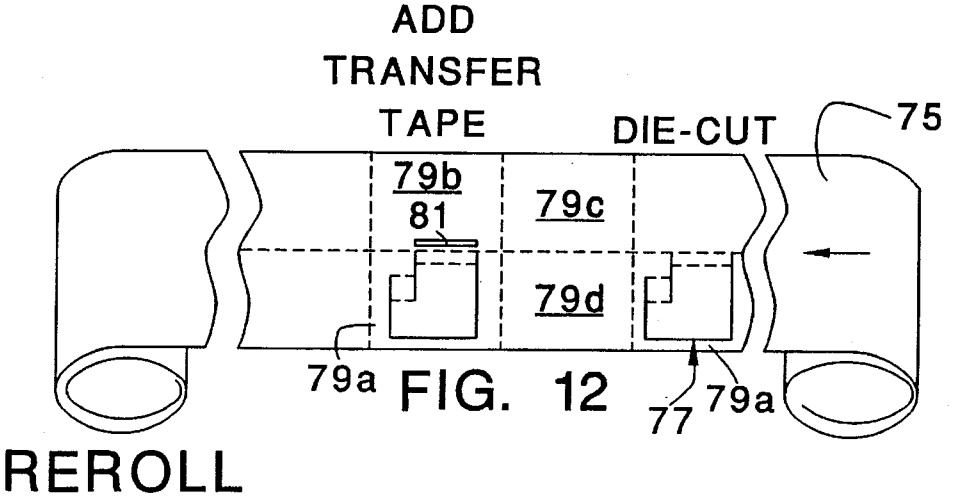
FIG. 12 is a perspective schematic view showing a continuous web of sheet material being die-cut, processed and then re-rolled.

As illustrated in FIG. 12, a web 75 of sheet material is unrolled and then re-rolled after fabricating; if desired, it could be run in the opposite direction so that it would be oriented for installation in the point-of-sale dispenser at the end of fabrication. The web 75 is designed to provide a series of structurally identical blanks 83 each of which will provide 4 panels in the ultimate greeting card piece or the like. The web 75 is first die-cut to create a stand-out structure 77 in panel 79*a* while the other 3 panels remain imperforate. Following the die-cutting step, a strip of transfer tape 81 is applied to the panel 79*b*, aligned with a subpanel of the die-cut stand-out 77. Transfer tape carries a strip of pressure-sensitive adhesive which adheres to the desired location in the panel 79*b* and transfers to that panel because a release coating on the tape liner layer allows it to be readily removed, thus "activating" the adhesive for purpose of joinder by exposing the upper adhesive surface. Alternatively, co-adhesive could be applied as previously described and shown in respect of FIGS. 9 and 10. Following the application of the transfer tape 81, the fabricated web 75 is re-rolled.

Figure 13:
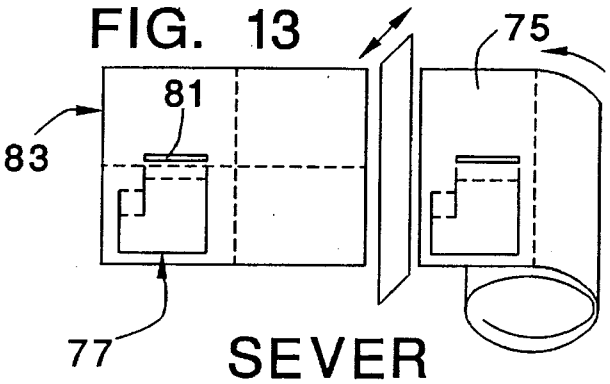
FIG. 13 shows a single item being severed from a roll fabricated in FIG. 12.
Figure 14A:
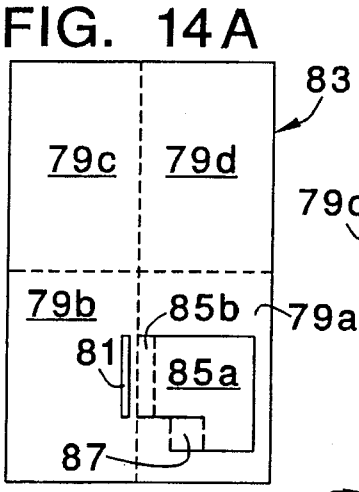
FIG. 14A shows a 4-panel die-cut item in the form as severed in FIG. 13.
Figure 14B:
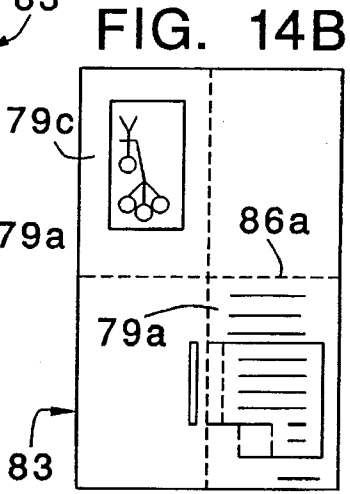
FIG. 14B shows the 4-panel item following printing.
Figure 16:
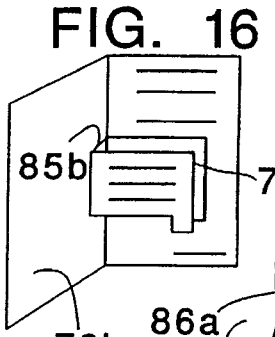
FIG. 16 shows the completed dimensional piece in its open position.
Figure 15A:
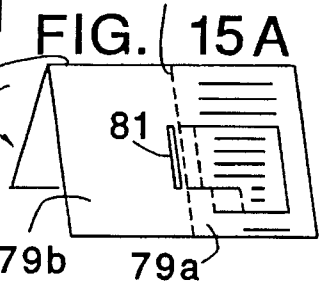
FIG. 15A shows the first step in the folding operation for this item.
Figure 15B:
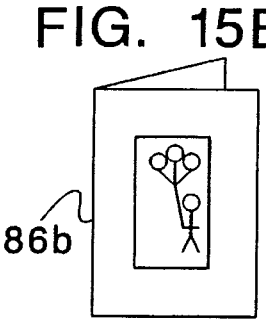
FIG. 15B shows the second step in the folding operation.

The web 75 in roll form is then supplied to a greeting card printing and dispensing machine which utilizes such a roll stock to provide blanks 83 for personalized printing. As can be seen in FIG. 13, the web 75 in roll form is severed by a reciprocating blade or the like to create a single 4-panel sheet material blank 83. As best seen in FIG. 14A, panel 79*a* of the blank 83 is die-cut to form the stand-out structure 77 including a main body 85*a*, a rectangular base subpanel 85*b* and a linkage arm 87. The piece 83 is then appropriately printed by the computer-driven laser printer so that an illustration then appears on what will be the front of the folded card, i.e. the panel 79*c*, and the selected greeting and verse are printed on the panel 79*a* in which the stand-out is die-cut. The blank 83 is then folded first about a horizontal line 86*a*, as shown in FIG. 15A, and then, as depicted in FIG. 15B, about a vertical line 86*b*. After the recipient signs the card and adds any personal greeting desired, the transfer tape 81 is removed, activating the underlying pressure-sensitive adhesive for joinder. When the greeting card is then closed and placed in an envelope, the base subpanel 85*b* becomes affixed to the facing panel 79*b*. When the greeting card is eventually opened by the recipient, the stand-out structure prominently arises from the plane of the panel 79*a* while remaining parallel thereto in attention-attracting fashion as depicted in FIG. 16.

Figures 17, 18, 19:
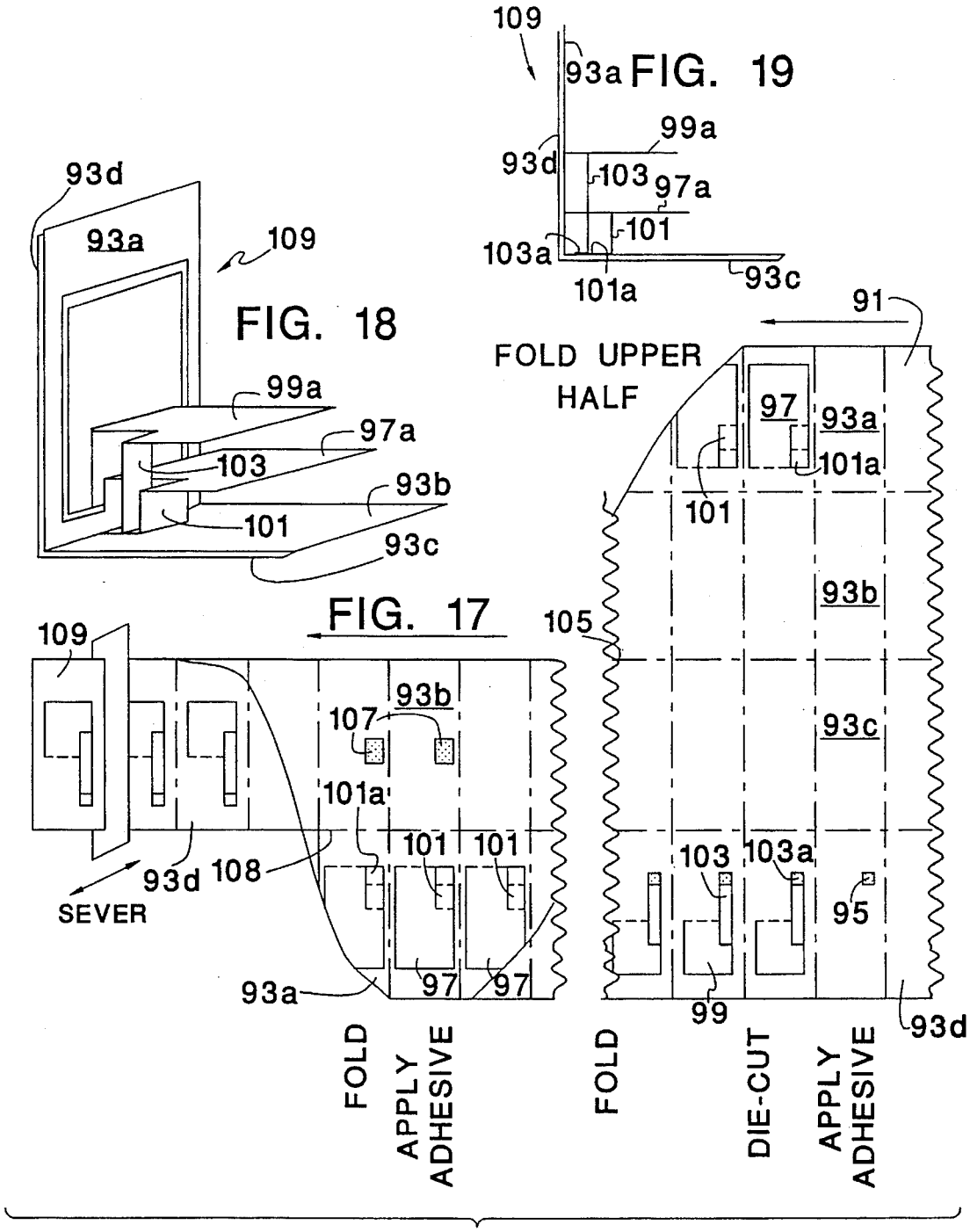
FIG. 17 shows a schematic view of a continuous web designed to be die-cut and treated to fabricate a series of structurally identical, 4-panel, dimensional items by folding the web twice as it moves from right to left.
FIG. 18 is a perspective view of a single dimensional item fabricated from the web of FIG. 17, which is shown in its open position.
FIG. 19 is a side view, reduced in size, of the 4-panel dimensional item of FIG. 18.

Illustrated in FIGS. 17–19 is a mass production method for transforming a continuous web of sheet material 91 into a series of structurally identical 4-panel, dimensional pieces.

In this arrangement, the 4 panels of each blank extend completely across the web, which is moving from right to left, and the web is proportioned and printed so as to provide a plurality of blanks for fabricating structurally identical dimensional pieces. In the sequence shown, the web 91 for purposes of explanation should be considered to be divided into panels 93*a* through 93*d*. In the first step of the illustrated method, an adhesive pattern 95 is applied to the panel 93*d*. Next, both panels 93*a* and 93*d* are die-cut to provide stand-out structures 97 and 99. The stand-out structures respectively include a main body 97*a*, 99*a*, a linkage arm 101, 103 and a connecting subpanel 101*a*, 103*a*. As can be seen from FIG. 17, the subpanel 103*a* carries the adhesive pattern 95 that was earlier applied.

The upper half of the web 91 is then folded onto the lower half, causing the panels 93*a* and 93*d* to come into surface contact with each other. Folding occurs along a horizontal line 105, and so long as the central region of the web occupied by the panels 93*c* is substantially imperforate, it can be conveyed under high tension so that the fabrication operation can be run at high speed. As a result of this contact between the facing halves of the web, the connecting subpanel 103*a* becomes affixed to one surface, i.e. the undersurface, of the corresponding connecting subpanel 101a of the stand-out structure 97. After the folding is complete, a second adhesive pattern 107 is applied to the panel 93*b* aligned in a corresponding location to the upper surface of the subpanel 101*a*. Next, the web is folded a second time, i.e. along a line 108, so that the panels 93*a* become superimposed atop the panels 93*b*, in which position the adhesive pattern 107 affixes the other surface of the connecting subpanel 101*a* to the facing panel 93*b*. The web 91 is then severed by a reciprocating knife blade or the like to create a series of individual dimensional pieces 109.

When the piece 109 is opened, as depicted in FIGS. 18 and 19, the stand-out structures 97 and 99 move into a 3-dimensional orientation generally parallel to each other, and the linkages 101, 103 are proportioned so that the main bodies 97*a*, 99*a* are oriented generally perpendicular to the panel 93*a* when the opening angle is about 90°, as best seen in FIG. 19. The stand-out structures are moved to this orientation by the linkage arms 101 and 103 which are hinged at their upper ends to the main bodies 97*a* and 99*a* and are hinged at their lower ends to the connecting subpanels 101*a* and 103*a*. The subpanel 103*a* is affixed by the adhesive pattern 95 to the upper surface of the subpanel 101*a*, and the undersurface of the subpanel 101*a* is affixed by the adhesive pattern 107 to the imperforate panel 93*b*.

Figures 20, 21, 22:
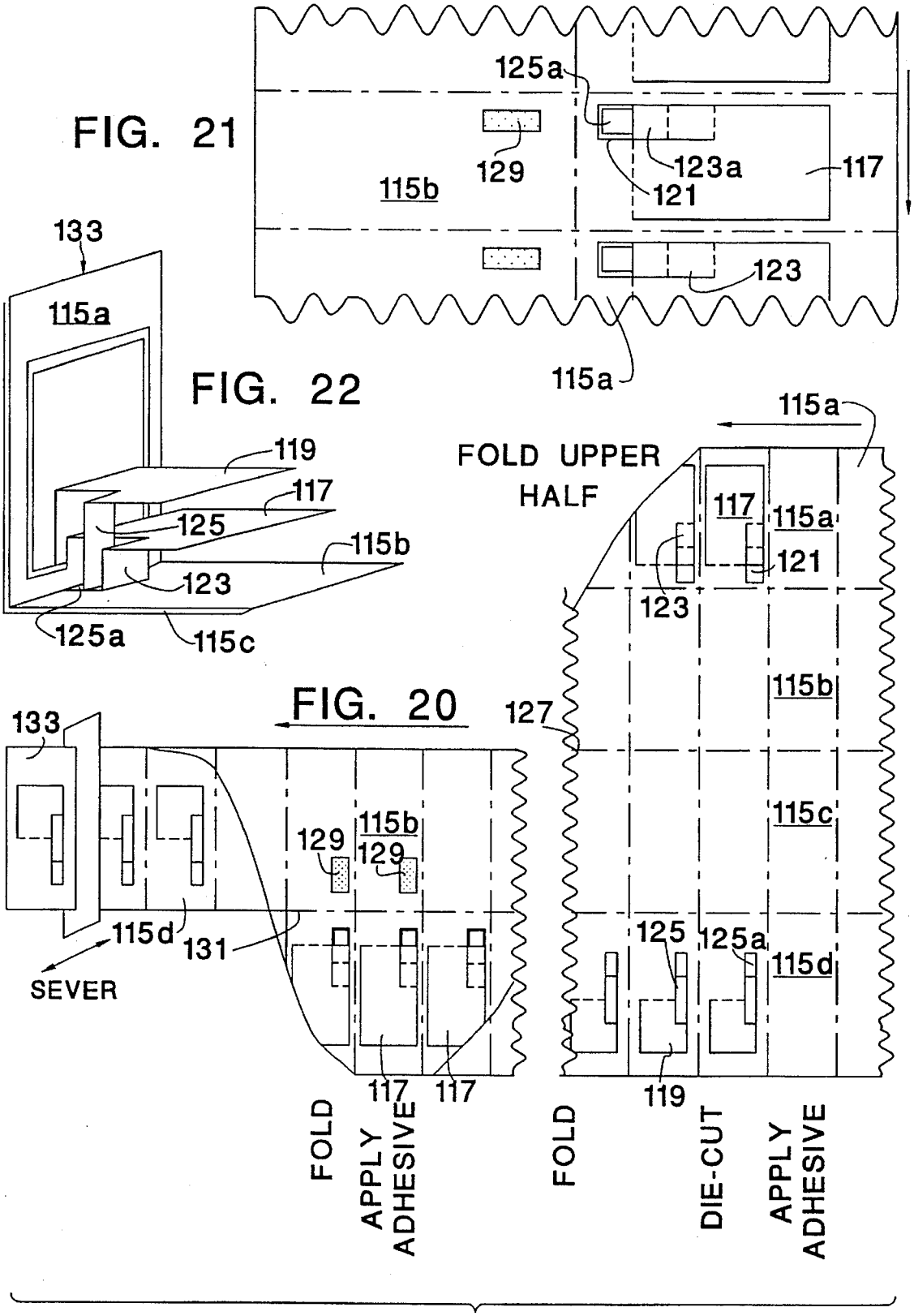
FIG. 20 is a view, similar to FIG. 17, showing an alternative embodiment of treating a generally similar web to produce a 4-panel dimensional item similar to that fabricated from the web shown in FIG. 17.
FIG. 21 is an enlarged view of a section of the web of FIG. 20.
FIG. 22 is a perspective view showing the dimensional item fabricated from the web of FIGS. 20 and 21 shown in the open position.

Illustrated in FIGS. 20, 21 and 22 is an alternative arrangement showing how dimensional pieces substantially the same as the pieces 109 can be created from a similar 4-panel across web arrangement using only a single adhesive-applying station. A similar web 113 having 4 panels 115*a, b, c* and *d* is provided which is die-cut so as to produce a stand-out structure 117 in the panel 115*a* and a stand-out structure 119 in the panel 115*d*. However, in addition to the stand-out structure 117, an additional rectangular window 121 is die-cut adjacent the stand-out structure 117, and the small sheet material rectangle is removed by suction , or by air or mechanical means, from the web to leave to leave the open window 121. The stand-out structure 117 has a linkage arm 123 with a connecting subpanel 123*a* that is generally the same as in the FIG. 17 configuration. The stand-out structure 119 has a linkage 125 which includes an elongated connecting subpanel 125*a* that, after folding, extends into alignment with the region of the open window, as can be seen in the left-hand portion of FIG. 20 and in the enlarged view shown in FIG. 21.

The web 113 is folded along a horizontal centerline 127 so that the panels 115*a* and 115*b* are superimposed atop the panels 115*c* and 115*d*. An elongated adhesive pattern 129 is then applied to the panel 115*b* in a location where it will be aligned with both the subpanel 125*a* that is located just below the window and the subpanel 123*a* of the other linkage. The final folding step then takes place along a line 131 so as to place the panels 115*a* in surface-to-surface contact with the panels 115*b*, and subsequently, the twice-folded web is severed so as to create individual dimensional pieces 133.

When the piece 133 is opened, it appears essentially the same as the piece 109 illustrated in FIG. 18. Because of the presence of the window 121, both the connecting subpanel 125*a* and the connecting subpanel 123*a* are affixed to the surface of the panel 115*a* by the elongated adhesive pattern 129.

Although the invention has been described with regard to a number of presently preferred embodiments, which illustrate the best mode known to the inventors for carrying out the invention, it should be understood that various changes and modifications as would be obvious to those having ordinary skill in this art may be made without departing from the scope of the invention which is defined in the claims appended hereto. For example, the various types of adhesive and other bonding applications shown in any of these different embodiments are generally considered to be equally applicable to other of the illustrated embodiments and, as indicated before, other types of co-adhesive and thermally or UV-activated adhesives can be employed. Generally, such adhesive can be applied to the opposite or facing panel from that illustrated, or to both panels. Also, the linkage lines of weakness preferably achieved during the die-cutting step might be omitted because of paper thinness or could inherently exist without being die-cut on a specific line when paper grain and strength design are so arranged. By substantially imperforate is meant that at least about 80% of the web is integral to provide structural strength adequate to run high speed fabricating, e.g. small apertures could be included in the panel in question without significantly detracting from strength. Although the invention has been illustrated in part with respect to fabrication from a continuous web, it should be understood to be equally applicable to blanks that can be sheet-fed into suitable folding apparatus or individually fed through copy machines or laser printers and then manually manipulated following printing to achieve the finished piece as well. The lines of weakness, the linkages or the main body portions could be aligned angularly, as well as parallel, to the hinge line, as shown in FIGS. 9–11. Although the disclosure shows the folding of the interconnected panels of a web which is considered to have particular efficiency in mass-production operations, it should be understood that strips of a web each containing one of two such panels can be similarly hinged together along a straight line by severing the web and then manipulating the separate web portions to glue them together along a false backbone or the like, which is considered to be an equivalent of certain folding operations.

Particular features of the invention are emphasized in the claims that follow.

What is claimed is:

1. A blank for fabricating an attention-attracting piece, said blank comprising sheet material designed to be formed into at least first and second panels connected to each other along a main hinge line, die-cut means in said first panel forming a stand-out structure having a main body portion, at least one line of weakness in said blank along which said main body portion is hinged to the remainder of said blank, said die-cut means also forming link means in said sheet material as a part of said stand-out structure, said link means being hinged to said main body portion of said stand-out structure, and bonding means for interconnecting said stand-out structure in said first panel to a region of said second panel of said sheet material which lies across said main hinge line from said first panel, so that interconnection between said stand-out structure and said second panel occurs upon manipulation of said sheet material to achieve superimposition of one said panel upon said other panel, thereby completing said fabricated piece whereby opening of said fabricated piece thereafter causes said stand-out structure to move prominently away from the remainder of said first panel in an attention-attracting mode.

2. A blank according to claim 1 wherein said link means is partially defined by a pair of lines of weakness one of which serves to hingedly connect said link means to said main body portion and the other of which forms a hinge to the remainder of said first panel.

3. A blank according to claim 2 wherein said link means pair of lines of weakness are parallel to each other and to said main hinge line.

4. A blank according to claim 1 wherein said main body portion has hinged thereto along another line of weakness a base subpanel and wherein said base subpanel becomes interconnected with said second panel through said bonding means.

5. A blank according to claim 4 wherein said main hinge line is a fold-line and said link means is defined by two hinge lines that are parallel to said fold-line and are spaced-apart from each other a distance so that said main body portion assumes an orientation generally parallel to said first panel when said fabricated piece is opened to a position wherein said first panel and said second panel are at about right angles to each other.

6. A blank according to claim 4 wherein said die-cut means extends to said main hinge line and wherein said base subpanel is hinged to said stand-out structure along said another line of weakness which is parallel to said main hinge line and carries adhesive means as said bonding means for attachment to said second panel.

7. A blank according to claim 6 wherein said link means interconnects said stand-out structure and the remainder of said first panel along a pair of parallel fold-lines.

8. A blank according to claim 1 wherein said link means includes a connecting subpanel at a free end thereof and an opposite end which is hinged to said stand-out structure, and wherein said bonding means includes an adhesive pattern located on at least one of said connecting subpanel and an aligned location on said second panel, which adhesive pattern will interconnect said connecting subpanel and said second panel in surface-to-surface contact upon superimposition of said first and second panels.

9. A blank according to claim 8 wherein said first and second panels are interconnected by a fold-line which constitutes said main hinge line and said bonding means comprises co-adhesive material on both said subpanel and said second panel aligned location.

10. A blank according to claim 1 wherein said sheet material is designed to be formed into first, second, third and fourth panels respectively interconnected by a central hinge line and two flanking main hinge lines one of which constitutes said main hinge line, wherein die-cut means in said fourth panel forms a second stand-out structure of a size smaller than said stand-out structure in said first panel, said second stand-out structure including second link means, wherein subpanels are formed at a free end of each said link means, and wherein folding of said blank about said central hinge line superimposes said die-cut first and fourth panels and subsequent folding about both said flanking hinge lines superimposes all four panels with said first panel in abutting contact between said second panel and said fourth panel and with said bonding means attaching said subpanels of each said link means directly or indirectly to said second panel so that, upon opening of said fabricated piece, said second stand-out structure moves through an opening formed in said first panel by said die-cut means which defines said stand-out structure.

11. A blank according to claim 10 wherein said bonding means includes adhesive patterns for bonding one surface of said link means subpanel of said stand-out structure to said second panel and for bonding the other surface of said link means subpanel to said link means subpanel of said second stand-out structure.

12. A blank according to claim 10 wherein said first panel also includes aperture means adjacent said link means subpanel and wherein said bonding means includes a single adhesive pattern on said second panel for bonding both said link means subpanels thereto as a result of said subsequent folding about said flanking hinge lines so that both said link means subpanels become directly attached to said second panel.

13. A four-panel piece made from a blank according to claim 10 which has two of said stand-out structures which are oriented parallel to each other in a open position.

14. A blank for fabricating an attention-attracting item, said blank comprising sheet material having a fold line situated therein and at least first and second panels and being designed to be folded at said fold-line along an edge of at least one of said first and second panels, die-cut means in the region of said first panel forming a stand-out structure which includes a main body portion having at least one line of weakness in said stand-out structure which extends generally parallel to said fold-line and forms subpanel means, said die-cut means also forming link means in said first panel as a part of said stand-out structure which hingedly connects the remainder of said first panel to the remainder of said stand-out structure at a location thereon spaced from the location of said line of weakness, said second panel being substantially imperforate, and adhesive means on said blank for interconnecting said subpanel means in said first panel to said second panel at respective locations on opposite sides of said fold-line, so that attachment of said subpanel means in surface contact with said second panel occurs upon folding of said blank along said fold-line to bring said first and second panels into superimposition with each other to create said fabricated item, whereby unfolding of said fabricated item thereafter causes said stand-out structure to move prominently away from said remainder of said first panel in an attention-attracting mode.

15. A blank according to claim 14 wherein said subpanel means is hinged to an edge of said second.

16. A blank according to claim 14 wherein the length of said link means is such that said main body portion of said stand-out structure assumes an orientation parallel to said remainder of said first panel when it has moved away therefrom.

17. A blank according to claim 14 wherein said die-cut means extends to said fold-line, wherein said subpanel means is hinged along said fold-line to said second panel, and wherein said adhesive means is pressure-sensitive adhesive covered by a release layer which is carried by said second panel.

18. A blank according to claim 14 wherein said adhesive means comprises a layer of co-adhesive material on said subpanel means and complementary co-adhesive material located at a corresponding location on said second panel to contact said subpanel means upon said folding of said first and second panels to achieve said superimposition.

19. A blank for fabricating an attention-attracting item, said blank comprising sheet material having a fold line situated therein and at least first and second panels and designed to be folded at said fold-line along at least one of said first and second facing panels, with said second panel being substantially imperforate, die-cut means in said first panel forming a first stand-out structure which includes a main body portion having at least one line of weakness that extends generally parallel to said fold-line and forms first subpanel means, said die-cut means also forming first link means in said first panel as a part of said stand-out structure, said link means hingedly connecting the remainder of said first panel to the remainder of said stand-out structure at a location spaced from the location of said line of weakness, said die-cut means further forming a second stand-out structure within said first stand-out structure and secondary link means as a part thereof, said secondary link means having opposite ends and having a hinge line at one end thereof and second subpanel means at the opposite end thereof, and adhesive means on said sheet material for interconnecting said first and second subpanel means to said substantially imperforate second panel at respective locations on opposite sides of said fold-line, so that, upon folding of said sheet material along said fold-line to bring said first and second panels into superimposition with each other, said first and second subpanel means become attached in surface contact with said second panel, whereby opening of said item thereafter causes said first and second stand-out structures to move prominently away from said remainder of said first panel in attention-attracting modes with said second stand-out structure having an orientation transverse to said first stand-out structure.

20. A blank according to claim 19 wherein said first link means includes a pair of parallel links which laterally flank said main body portion of said first stand-out structure, and wherein said die-cut means extends to said fold-line so that said first subpanel means is hinged along said fold-line to said second panel.

* * * * *

UNITED STATES PATENT AND TRADEMARK OFFICE

CERTIFICATE OF CORRECTION

PATENT NO. : 5,588,233

DATED : December 31, 1996

INVENTOR(S) : Volkert, et al.

It is certified that error appears in the above-indentified patent and that said Letters Patent is hereby corrected as shown below:

IN THE DRAWINGS: The attached Sheet 4 showing FIGS. 9, 10 and 11 is substituted for the duplicate of Sheet 5 that is printed as Sheet 4 of 7.

IN THE CLAIMS: Column 10, line 65, before the period, insert --panel along said fold-line--.

Signed and Sealed this

Twenty-ninth Day of July, 1997

Bruce Lehman

*Attest:*

BRUCE LEHMAN

*Attesting Officer*

*Commissioner of Patents and Trademarks*